US006633219B2

(12) United States Patent
Marbach et al.

(10) Patent No.: US 6,633,219 B2
(45) Date of Patent: Oct. 14, 2003

(54) COIL FOR AUTOMATED MOUNTING

(75) Inventors: Detlef Horst Marbach, Stassfurt (DE); Guenther Spee, Nettetal (DE); Hendricus Martinus Van Der Wijst, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/825,278

(22) Filed: Apr. 3, 2001

(65) Prior Publication Data

US 2001/0033175 A1 Oct. 25, 2001

(30) Foreign Application Priority Data

Apr. 6, 2000 (DE) ..... 100 16 974

(51) Int. Cl.[7] ..... H01F 17/00; H01F 5/00; H01F 27/29; H01F 27/24; H01F 21/10

(52) U.S. Cl. ..... 336/177; 336/200; 336/192; 336/212; 336/87

(58) Field of Search ..... 336/200, 192, 336/177, 212, 83

(56) References Cited

U.S. PATENT DOCUMENTS 4,402,027 A * 8/1983 Nakamura et al. ..... 360/123
4,537,850 A * 8/1985 Smeiman ..... 430/137
4,965,245 A * 10/1990 Sugimoto et al. ..... 505/431
5,107,366 A * 4/1992 Huang et al. ..... 359/223
5,221,892 A * 6/1993 Sullivan et al. ..... 323/362
5,572,412 A * 11/1996 Saeki et al. ..... 363/16
5,650,983 A * 7/1997 Kondo et al. ..... 369/13.17
6,227,450 B1 * 5/2001 Blake et al. ..... 235/462.36
6,228,788 B1 * 5/2001 Jean et al. ..... 501/32
6,320,384 B1 * 11/2001 Doty et al. ..... 324/321
6,348,850 B1 * 2/2002 Kimura et al. ..... 336/200

OTHER PUBLICATIONS

Abstract of Japan, 6–36937, Feb. 10, 1994, "inductor and its Manufacture".

Patent Abstracts of Japan, vol 014, No. 045, Jan. 1990, JP 01 276508 A, "Inductor and its Manufacture".

Patent Abstracts of Japan vol, 018, No 252, May 1994, JP 06 036937 A, "Electromagnetic Coil Conductive Wire and Electromagnetic Coil".

* cited by examiner

*Primary Examiner*—Andrew H. Hirshfeld
*Assistant Examiner*—Wasseem H. Hamdan

(57) ABSTRACT

The present invention relates to a coil (1) having a plurality of turns (2). The characteristic feature of the invention is that the turns (2) include a magnetic material or the turns (2) have an outer layer for carrying an electric current and have a magnetic material in their interior.

12 Claims, 2 Drawing Sheets

COIL FOR AUTOMATED MOUNTING

BACKGROUND OF THE INVENTION

1. The Field of the Invention

The present invention relates to a coil having a plurality of turns.

2. Description of the Related Art

Modern electrical apparatuses often require many coils, which are mounted on the printed circuit boards of the relevant electrical apparatus. The coils should combine very good electrical properties with a compact construction and a great ease of mounting. From JP-A 06 036937, a coil having a magnetic core is known, in which the magnetic stray flux is minimized in that the turns of the coil and the core form a single part.

SUMMARY OF THE INVENTION

It is an object of the present invention to provide a coil having minimal stray losses through the air gap between the turns of the coil and which enables a simple and fully automatic mounting on a printed circuit board to be achieved.

With an air coil in accordance with the invention this object is achieved in that the turns include a magnetic material. According to the invention said object is achieved in that the turns include an outer layer for carrying an electric current and a magnetic material in their interior. Air gaps between individual turns of the coil produce a stray flux and adversely affect the electrical properties of such a coil. In order to avoid these air gaps, the turns of a coil in accordance with the invention consist of magnetic wire. The individual turns of the coil are firmly held together by the magnetic forces between these turns, as a result of which air gaps between the turns are avoided. For this purpose, the turns of the coils need neither be glued together nor need they be wound onto a core or held together by other additional means. The coil is wound to the desired shape and retains its shape as a result of the magnetic forces between the turns. This allows a simple manufacture, particularly in the case of production in large quantities.

One embodiment of the present invention is particularly suitable for uses in high frequency technology, which usually employs air coils without cores. In order to improve the conductivity for high frequency currents, the magnetic wire, from which the air coil is wound, is clad with a material which is particularly suitable for high frequency uses. For this purpose, the magnetic wire is clad with a layer of gold, silver or copper.

Another embodiment of the present invention substantially facilitates the mounting of the coil. To enable the automatic mounting machine to detect the shape of the coil and its correct mounting direction, the coil should provide the appropriate information to the automatic mounting machine. A simple possibility of providing this information is that the automatic mounting machine has a magnetic sensor, which detects the degree and the type of magnetization of the coil to be mounted. Since the magnetization differs in dependence on the length of the coil and differently magnetized wires can be used, different coils can be detected with the aid of their magnetic properties.

A further embodiment of the present invention enables the coil to be mounted fully automatically on printed circuit boards. Particularly, in the case of SMD mounting (Surface Mounted Device), this enables a high production rate to be obtained. During SMD mounting, the parts are secured to that side of the printed circuit board, on which they are mounted.

BRIEF DESCRIPTION OF THE DRAWINGS

An embodiment of the present invention will now be described in more detail by way of example with reference to several Figures. In the drawings.

DETAILED DESCRIPTION OF THE INVENTION

Figure 1:
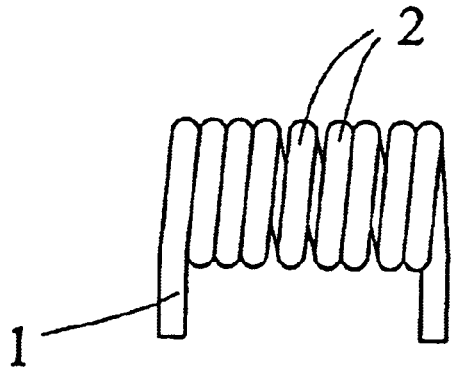
Fig.1 PRIOR ART
FIG. 1 shows a conventional air coil.
Figure 2:
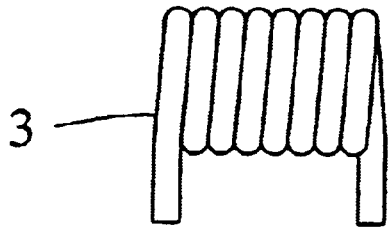
FIG. 2 shows an air coil of magnetic wire in accordance with the invention.
Figure 3:
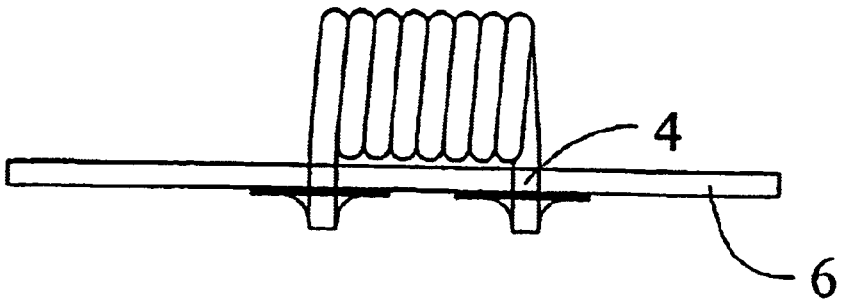
FIG. 3 shows the air coil in accordance with the invention mounted on a printed circuit board.
Figure 4:
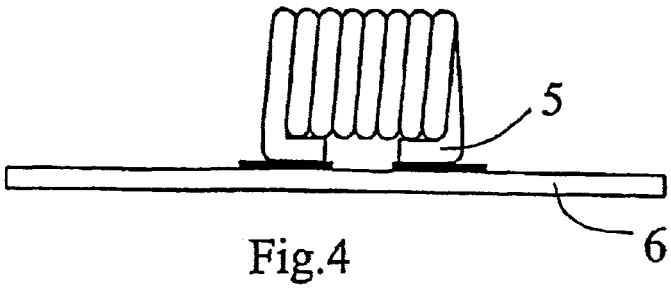
FIG. 4 shows the air coil in accordance with the invention mounted on a printed circuit board using SMD technology.

Conventional coils 1, as shown in FIG. 1, have the problem that after winding air gaps are formed between the turns 2. However, these air gaps affect the electromagnetic properties of the coil 1. Therefore, the turns 2 of the coil in accordance with the invention as shown in FIG. 2 consist of magnetic wire, as a result of which the turns 2 are held together without any further means. Thus, after winding, the coil 1 retains its final shape and no air gaps as shown in FIG. 1 are formed. Moreover, an automatic mounting machine can distinguish between different coil types by means of a magnetic sensor on the basis of the magnetization, which differs in magnitude and orientation depending on the length and size of the coil 1. In order to optimize the coil 1 for high frequency uses, the magnetic wire is provided with a cladding 3 of gold, silver, copper or another well conducting material prior to winding. FIG. 3 shows the coil 1 in accordance with the invention mounted on a printed circuit board 6. The coil leads are then passed through bores 4 in the printed circuit board and the coil is secured from the underside, for example by means of a soldering operation. Alternatively, the coil 1 shown in FIG. 4 is secured to the upper surface without the bores 4 by means of SMD technology. For this purpose, the coil has specially bent terminal lugs 5, which are mounted directly onto the printed circuit board 6.

Figure 5:
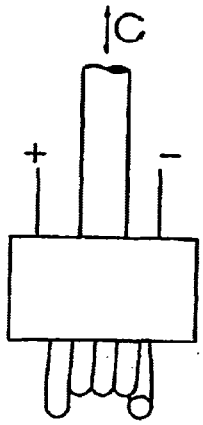
FIG. 5 shows an electromagnetic automatic mounting machine.
Figure 6:
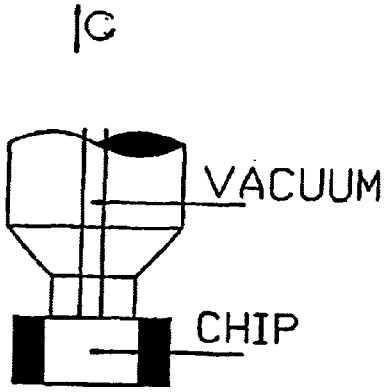
FIG. 6 shows an automatic mounting machine using vacuum technology.

During the mounting process shown in FIG. 5, the coils 1 are picked up by the automatic mounting machine with the aid of an electromagnet and are placed onto the printed circuit board 6, aligned and secured. Alternatively, as is shown in FIG. 6, the coils 1 can be picked up by the automatic mounting machine by means of a vacuum and can then be mounted.

What is claimed is:

1. An air coil (1), comprising:

a pair of terminals (5); and a plurality of turns (2) between said pair of terminals, wherein said plurality of turns (2) are composed of magnetic material independently producing a magnetic force between the plurality of turns (2), said magnetic force holding the plurality of turns together to avoid air gaps between the turns.

2. The air coil (1) of claim 1, wherein said plurality of turns (2) of said air coil (1) are clad with copper.

3. The air coil (1) of claim 1, wherein said plurality of turns (2) of said air coil (1) are clad with gold.

4. The air coil (1) of claim 1, wherein said plurality of turns (2) of said air coil (1) are clad with silver.

5. The air coil (1) of claim 1, wherein a shape and an orientation of said air coil (1) is determinable when said air coil is mounted (1) on the basis of a type and a degree of magnetization of said plurality of turns (2).

6. The air coil (1) of claim 1, wherein said air coil (1) is adapted to be mounted on a printed circuit board (6) by an automatic mounting machine operable to control a mounting of said air coil (1) onto the printed circuit board (6) by an electromagnetic force or vacuum force.

7. An air coil (1), comprising:

a pair of terminals (5); and a plurality of turns (2) between said pair of terminals, wherein said plurality of turns (2) includes an exterior material (3) for carrying an electric current, and an interior magnetic material independently producing a magnetic force between the plurality of turns (2), said magnetic force holding the plurality of turns together to avoid air gaps between the turns.

8. The air coil (1) of claim 7, wherein said plurality of turns (2) of said air coil (1) are clad with copper.

9. The air coil (1) of claim 7, wherein said plurality of turns (2) of said air coil (1) are clad with gold.

10. The air coil (1) of claim 7, wherein said t plurality of urns (2) of said air coil (1) are clad with silver.

11. The air coil (1) of claim 7, wherein a shape and an orientation of said air coil (1) is determinable when said air coil is mounted (1) on the basis of a type and a degree of magnetization of said plurality of turns (2).

12. The air coil (1) of claim 7, wherein said air coil (1) is adapted to be mounted on a printed circuit board (6) by an automatic mounting machine operable to control a mounting of said air coil (1) onto the printed circuit board (6) by an electromagnetic force or vacuum force.

* * * * *